US005148852A

United States Patent [19]

Oishi

[11] Patent Number: 5,148,852

[45] Date of Patent: Sep. 22, 1992

[54] COMPRESSED AIR BLOWING APPARATUS FOR USE IN GREEN SAND MOLD MOLDING FACILITY

[75] Inventor: Ukichi Oishi, Toyokawa, Japan

[73] Assignee: Sintokogio, Ltd., Nagoya, Japan

[21] Appl. No.: 804,643

[22] Filed: Dec. 10, 1991

[30] Foreign Application Priority Data

Dec. 14, 1990 [JP] Japan ..... 2-403415[U]
Dec. 14, 1990 [JP] Japan ..... 2-403417[U]

[51] Int. Cl.[5] ..... B22C 15/00
[52] U.S. Cl. ..... 164/169; 164/37
[58] Field of Search ..... 164/169, 37, 200, 201, 164/202

[56] References Cited

U.S. PATENT DOCUMENTS

| | | | |
|---|---|---|---|
| 4,565,233 | 1/1986 | Fischer et al. | 164/169 X |
| 4,572,274 | 2/1986 | Zimmermann | 164/169 |

FOREIGN PATENT DOCUMENTS

| | | | |
|---|---|---|---|
| 3327822 | 2/1985 | Fed. Rep. of Germany | 164/169 |
| 210530 | 6/1984 | German Democratic Rep. | 164/169 |
| 1-80247 | 5/1989 | Japan . | |
| 521993 | 9/1976 | U.S.S.R. | 164/169 |
| 1397152 | 5/1988 | U.S.S.R. | 164/169 |
| 1461585 | 2/1989 | U.S.S.R. | 164/169 |
| 1496910 | 7/1989 | U.S.S.R. | 164/169 |

*Primary Examiner*—J. Reed Batten, Jr.
*Attorney, Agent, or Firm*—Armstrong, Nikaido, Marmelstein, Kubovcik & Murray

[57] ABSTRACT

A compressed air blowing apparatus for supplying compressed air to molding sand placed in a flask is arranged in such a manner that its compressed air reservoir tank is constituted by a surface-plate frame and a cover, the frame having a compressed-air outlet port which can be opened/closed by a sectioning device and a piston which can be vertically moved. The sectioning device is constituted by concentrically disposed large and small cylindrical members by a cover member secured to the large and small cylindrical members having air feed holes formed between the large cylindrical member and the small cylindrical member and by connecting duct for communicating the outside of the cylindrical member with the inside of the small cylindrical members. As an alternative to this, the sectioning device is composed of a cylindrical member extending vertically and having a spur-like cross-sectional shape and a cover member hermetically secured to the lower end potion of the cylindrical member and having a spur-like air feed hole communicated with an inside space of the cylindrical member. When the piston is moved upwards, compressed air in the compressed air reservoir tank is quickly discharged by a large quantity through the outlet port via the sectioning device.

6 Claims, 4 Drawing Sheets

COMPRESSED AIR BLOWING APPARATUS FOR USE IN GREEN SAND MOLD MOLDING FACILITY

BACKGROUND OF THE INVENTION

1. Field of the Invention

The present invention relates to an apparatus for quickly blowing a large quantity of compressed air to the surface of molding sand for use in a green sand mold molding facility in such a manner that compressed air is blown to the surface of the molding sand present in a mold flask to penetrate the molding sand before compressed air is discharged from a pattern plate so as to previously compress the molding sand before the molding sand is further compressed.

2. Related Art Statement

A green sand mold molding facility has been disclosed in Japanese Utility Model Laid-Open No. 1-80247. According to this disclosure, the green sand mold molding facility is arranged in such a manner that a cover member and a compressed air reserving tank having a compressed air outlet on the bottom plate thereof are disposed above a table for lifting a pattern plate on which a flask is placed. Furthermore, the above-described outlet is arranged in such a manner that it is opened/closed by a valve which is moved upwards/downwards when an air pressure cylinder performs extension/retraction of its piston rod. In addition, molding sand is injected into the flask before the upper end opening formed in the flask is closed by a cover member and as well as the tank is positioned on the cover member before the air pressure cylinder is operated to open the outlet formed in the bottom plate of the tank. As a result, compressed air in the tank is blown to the flask via the cover member to compress the molding sand and as well as penetrate the molding sand before the compressed air is discharged from the pattern plate. Then, compaction is performed by using a squeeze plate to compact and solidify the molding sand so that the green sand mold is molded.

In a green sand mold molding facility of the above described type, a large quantity of compressed air must be quickly blown to the molding sand placed in the flask. However, since the air pressure cylinder is communicated with a compressed air source via pipes, a switch valve and the like, the resistance caused by a residual compressed air which is inevitably present in the conduit and the inherent resistance of the pipe line causes, at the time of the operation of the air pressure cylinder, the operational speed to be lowered. As a result, the outlet cannot be opened at high speed to quickly blow the large quantity of compressed air, causing a problem in that the green sand mold molding facility cannot exhibit a high molding performance.

It is preferable that compressed air is introduced from the compressed air tank into the flask via a large-diameter cylindrical member. In order to achieve this, a large-diameter opening/closing valve must be provided for the cylindrical member to operate the opening/closing valve at a high speed. In order to operate the above-described opening/closing valve, excessively large power source must be provided. Furthermore, if a small gap is formed between the opening/closing valve and its seating portion at the time of initiation of the valve opening operation, compressed air is undesirably introduced through the above-described gap into the flask. Therefore, there arises another problem in that compressed air blown into the flask cannot be diffused equally and thereby the molding sand cannot be compacted down uniformly.

SUMMARY OF THE INVENTION

Accordingly, an object of the present invention is to provide an apparatus capable of quickly blowing a large quantity of compressed air into a flask placed on a pattern plate and accommodating molding sand.

According to one aspect of the present invention, there is provided a compressed air blowing apparatus including: a frame having an air outlet port formed for supplying compressed air into a flask; a cylindrical sectioning device disposed on said frame, having, in an end portion thereof, an air feed hole communicated with said air outlet port and having, in another end portion thereof, an opening communicated with said air feed hole; a cylinder disposed on said frame to surround said sectioning device; a piston capable of sliding in said cylinder; a first compressed air supply device having a compressed air reservoir tank for supplying compressed air to a first chamber which is formed on one side of said piston in said cylinder and in which said sectioning device is disposed; a second compressed air supply device for urging said piston to hermetically close said opening by supplying compressed air to second chamber formed on the other side of said piston in said cylinder; an exhaust hole for communicating said second chamber with the outside; and a valve for opening/closing said exhaust hole whereby, when said valve opens said exhaust hole, said piston pushed by compressed air supplied from said first compressed air supply device slides to open said opening and thereby compressed air supplied from said first compressed air supply device is introduced into said sectioning device through said opening before it is blown into said flask through said outlet port, characterized in that: a large and a small cylindrical members concentrically disposed and included in said sectioning device, wherein said opening is defined as an annular opening by end portions of said cylindrical members and including a plurality of connecting ducts which establish a communication between the outside of said large cylindrical member and the inside of said small cylindrical member and which extend in the radial direction, whereby compressed air supplied from said first compressed air supply device is introduced into said opening from both the outside of said large cylindrical member and the inside of said small cylindrical member when said piston slides away from said opening.

According to another aspect of the present invention, there is provided a compressed air blowing apparatus including: a frame having a air outlet port formed for supplying compressed air into a flask; a cylindrical sectioning device disposed on said frame and, having, in an end portion thereof, an air feed hole communicated with said air outlet port and having, in another end portion thereof, an opening communicated with said air feed hole; a cylinder disposed on said frame to surround said sectioning device; a piston capable of sliding in said cylinder to hermetically close said opening formed in said sectioning device; a first compressed air supply device having a compressed air reservoir tank for supplying compressed air to a first chamber which is formed on one side of said piston in said cylinder and in which said sectioning device is disposed; a second compressed air supply device for urging said piston to hermetically close said opening by supplying compressed air to a second chamber formed on the other side of said piston in said cylinder; an exhaust hole for communicating said second chamber with the outside; a valve for opening/closing said exhaust hole whereby, when said valve opens said exhaust hole, said piston pushed by compressed air supplied from said first compressed air supply device slides to open said opening and thereby compressed air supplied from said first compressed air supply device is introduced into said sectioning device through said opening before it is blown into said flask through said outlet port, characterized by a cylindrical member an end portion of which defined said opening and which is provided in said sectioning device, wherein said cylindrical member has a plurality of troughs extending in an axial direction thereof and arranged in its circumferential direction, said troughs projecting inwardly.

Other and further objects, features and advantages of the invention will be apparent more fully from the following description.

DETAILED DESCRIPTION OF PREFERRED EMBODIMENTS

First Embodiment

Figure 1:
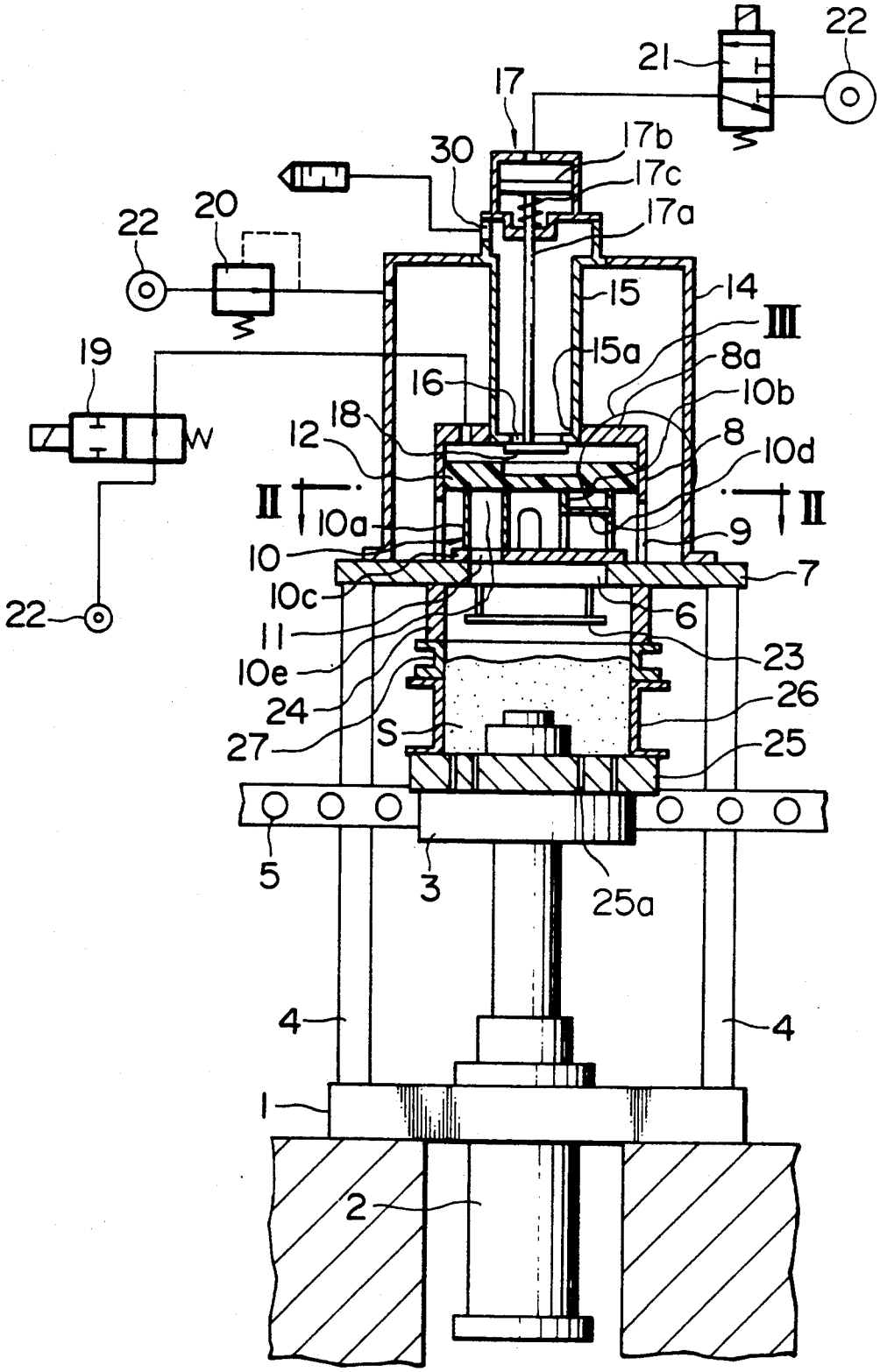
FIG. 1 is a front elevational cross-sectional view which illustrates a first embodiment of the present invention and from which a portion is cut out.
Figure 2:
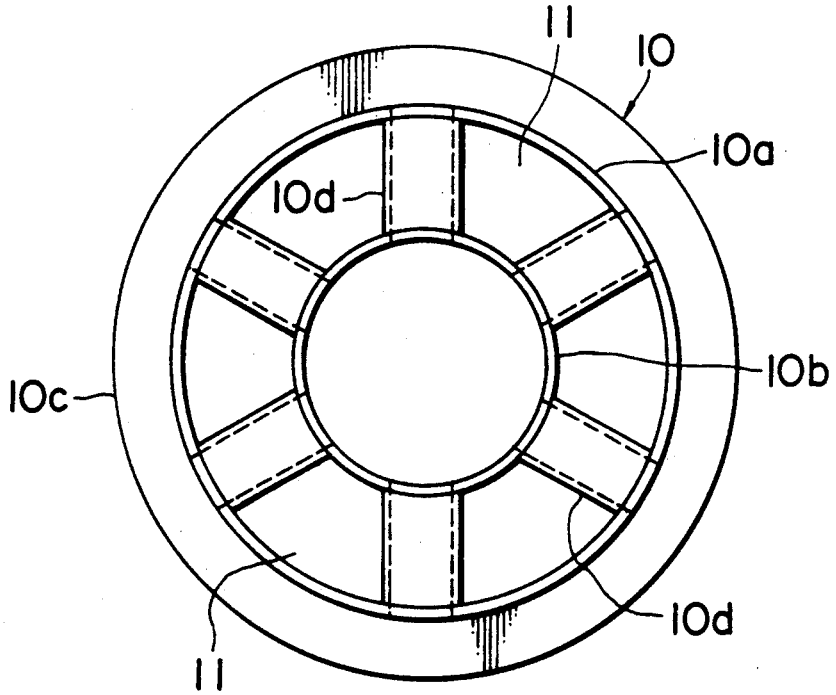
FIG. 2 is an enlarged view taken along line II—II of FIG. 1.

A first embodiment of the present invention will now be described with reference to the drawings. As shown in FIG. 1, a table 3 is, via a cylinder 2 facing upwards, disposed at the central portion of a surface-plate frame 1 in such a manner that the table 3 is able to move upwards/downwards. Furthermore, supporting columns 4 are erected at the four corners of the frame 1 in such a manner that a roller conveyer 5 having a flange laterally extending is disposed at an intermediate portion of the supporting columns 4 and a surface-plate frame 7 having, at the central potion thereof, a compressed air outlet port 6 is disposed at the top end portions of the supporting columns 4. On the upper surface of the surface-plate frame 7, a cylinder 8 extending vertically and having its top end portion closed by a cover 8*a* is secured, surrounding the top end portion of the outlet port 6, the cylinder 8 having air supply holes 9 in the lower portion thereof. At a position on the top surface of the surface-plate frame 7 and inside the cylinder 8, there is disposed a sectioning device 10 capable of efficiently supplying compressed air in a cover 14 which will be detailed hereinbelow to the outlet port 6. The sectioning device 10 comprises cylindrical members 10*a* and 10*b* positioned vertically and concentrically to each other and having large and small diameters and a cover member 10*c* secured to the lower end portions of the two cylindrical members 10*a* and 10*b* and having a plurality of air feed holes 11 formed between the large and small cylindrical diameter members 10*a* and 10*b*, the air feed holes 11 being formed in a fan-like shape (see FIG. 2). Each air feed hole 11 faces the outlet port 6. Furthermore, the outer surface of the large cylindrical member 10*a* and the inner surface of the small cylindrical member 10*b* are communicated with and connected to each other by a plurality of connecting ducts 10*d* as shown in FIG. 2. The ducts 10*d* establish connection between the inside of the small cylindrical member 10*b* and the outside of the large cylindrical member 10*a*. The two top end portions of the large cylindrical member 10*a* and the small cylindrical member 10*b* are opened, defining an opening 10*e*.

Figure 3:
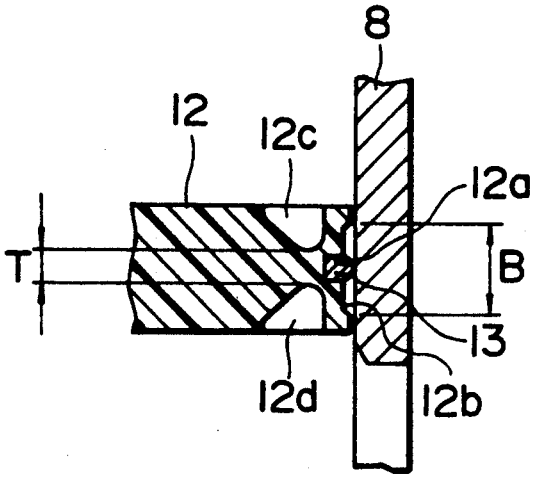
FIG. 3 is a detailed view which illustrates a portion III shown in FIG. 1.

A piston 12 is disposed above the sectioning device 10 in the cylinder 8, so as to be slidable in the vertical direction, the piston 12 being made of a synthetic resin and thereby being lightweight. Furthermore, the piston 12 is arranged in such a manner that it can be brought into contact with the top end portions of the large and the small cylindrical members 10*a* and 10*b* of the sectioning device 10 in a hermetical manner when it is moved downward. In addition, a seal 13 is, as shown in FIG. 3, fitted is a groove 12*a* formed in the outer peripheral surface of the piston 12. The piston 12 has a recess 12*b* formed in the body outer peripheral surface thereof and annular recesses 12*c* and 12*d* on the top and the lower surfaces thereof in such a manner that thickness T defined between the bottom surfaces of the top and lower recesses 12*c* and 12*d* is smaller than width B of the recess 12*b*. As a result, when the piston 12 having a thermal expansion coefficient which is larger than that of the cylinder 8 is expanded at an increased temperature, the top and the lower surfaces of the piston 12 can warp inwards, thereby preventing occurrence of an unfavorable problem.

Furthermore, a cover 14 is, as shown in FIG. 1, hermetically fastened to the top surface of the surface-plate frame 7, surrounding the cylinder 8, the cover 14 constituting a compressed air reservoir tank in cooperation with the surface-plate frame 7. In addition, a cylindrical exhaust pipe 15 is hermetically fastened to the central portion of the ceiling of the cover 14, the exhaust pipe 15 vertically penetrating the ceiling and extending downwards. The exhaust pipe 15 hermetically penetrates the cover 8*a* of the cylinder 8, the exhaust pipe 15 having a second exhaust hole 30 in the upper portion thereof and a bottom plate 15*a* at the lower end portion thereof. The bottom plate 15*a* has a large-diameter first exhaust hole 16. In addition, a cylinder 17 facing downwards is fastened to the top end surface of the exhaust pipe 15, while a valve 18 capable of closing the above-described first exhaust hole 16 underneath the latter is fastened to the lower end portion of a piston rod 17*a* of the piston 17*b* in the cylinder 17, the piston 17*b* is urged upwards by a coil spring 17*c*.

The upper chamber above the piston 12 of the cylinder 8 and an upper portion of the cylinder 17 are respectively communicated with a compressed air source 22 via opening/closing valve 19 and a 3-port 2-position switch valve 21, respectively. Further, the inside of the cover 14 is communicated with the air source 22 by way of a reducing valve 20.

Referring to FIG. 1, reference numeral 23 represents an air diffusion plate secured to the lower surface of the surface-plate frame 7, 24 represents a frame fastened to the surface-plate frame 7 in such a manner that it surrounds the air diffusion plate 23, 25 represents a pattern plate having a vent hole 25*a*, 26 represents a flask and 27 represents a cheek flask.

Then, the operation of the apparatus thus-constituted will now be described. The switch valve 21 is switched to the position disconnected from the compressed air source 22. The opening/closing valve 19 is opened to the position connected to the compressed air source 22 and the reducing valve 20 is adjusted to set the pressure of compressed air to a predetermined value, and then preferentially supply it to the inside of the cover 14. In this state, molding sand S is supplied into the flask 26 and the cheek flask 27 on the pattern plate 25, and, the molding sand S is conveyed to a position above the table 3 by the roller conveyer 5. Then, the cylinder 2 is extended to move the table 3 upward so that the cheek flask 27 is brought into contact with the frame 24. Then, the opening/closing valve 19 is closed to stop the supply of compressed air into the chamber above the piston 12 in the cylinder 8. Then, the switch valve 21 is switched, causing the cylinder 17 to extend its piston rod 17*a*. As a result, the valve 18 is moved downwards so that the first exhaust hole 16 is opened.

When the first exhaust hole 16 is opened, compressed air in the chamber above the piston 12 in the cylinder 8 is discharged outside after it has passed through the first exhaust hole 16, the exhaust pipe 15 and the second exhaust hole 30. Therefore, the pressure in the chamber above the piston 12 in the cylinder 8 is lowered. Furthermore, the pressure of compressed air effects on the outer surface of the large cylindrical member 10*a* at a portion of the lower surface of the piston 12 and the inner portion of the small cylindrical member 10*b*. As a result, the piston 12 is pushed upwards at high speed so that the opening 10*e* between the large and the small cylindrical members 10*a* and 10*b* of the sectioning device 10 is opened. Therefore, compressed air present around the large cylindrical member 10*a* and that present in the small cylindrical member 10*b* are, through the opening 10*e* of the same, introduced into an annular space formed by the above-described cylindrical members 10*a* and 10*b*. Since compressed air has been introduced into the small cylindrical member 10*b* through the air feed ducts 10*d* in the above-described state, a large quantity of compressed air is quickly introduced into the annular space present between the large and the small cylindrical members 10*a* and 10*b* from the inside and outside thereof.

Compressed air introduced into the annular space between the large and the small cylindrical members 10*a* and 10*b* passes through the air feed holes 11 and then is blown quickly by a large quantity into the flasks 26, 27. Then, it is diffused by the air diffusion plate 23 to compress the molding sand S, and penetrates the molding sand before it is discharged through the vent hole 25*a* formed in the pattern plate 25. As a result, the molding sand S is compressed. After the molding sand S has been compressed, the cylinder 17 is retracted by switching the switch valve 21 so as to close the first exhaust hole 16 by means of the valve 18. Then, the table 3 or the like is moved downwards by the retracting operation of the cylinder 2. Then, compressed air is supplied to the chamber above the piston 12 in the cylinder 8 by opening the opening/closing valve 19 so as to move the piston 12 downward. As a result, the piston 12 is brought into contact with the upper surfaces of the large and the small cylindrical members 10*a* and 10*b*. Therefore, the opening 10*e* between the large and small cylindrical members 10*a* and 10*b* of the sectioning device 10 is closed. The molding sand S, which has been compressed is conveyed to the next station where it is further properly compressed. Thus, one cycle of the operation of the apparatus according to the present invention is completed.

Second Embodiment

Figure 4:
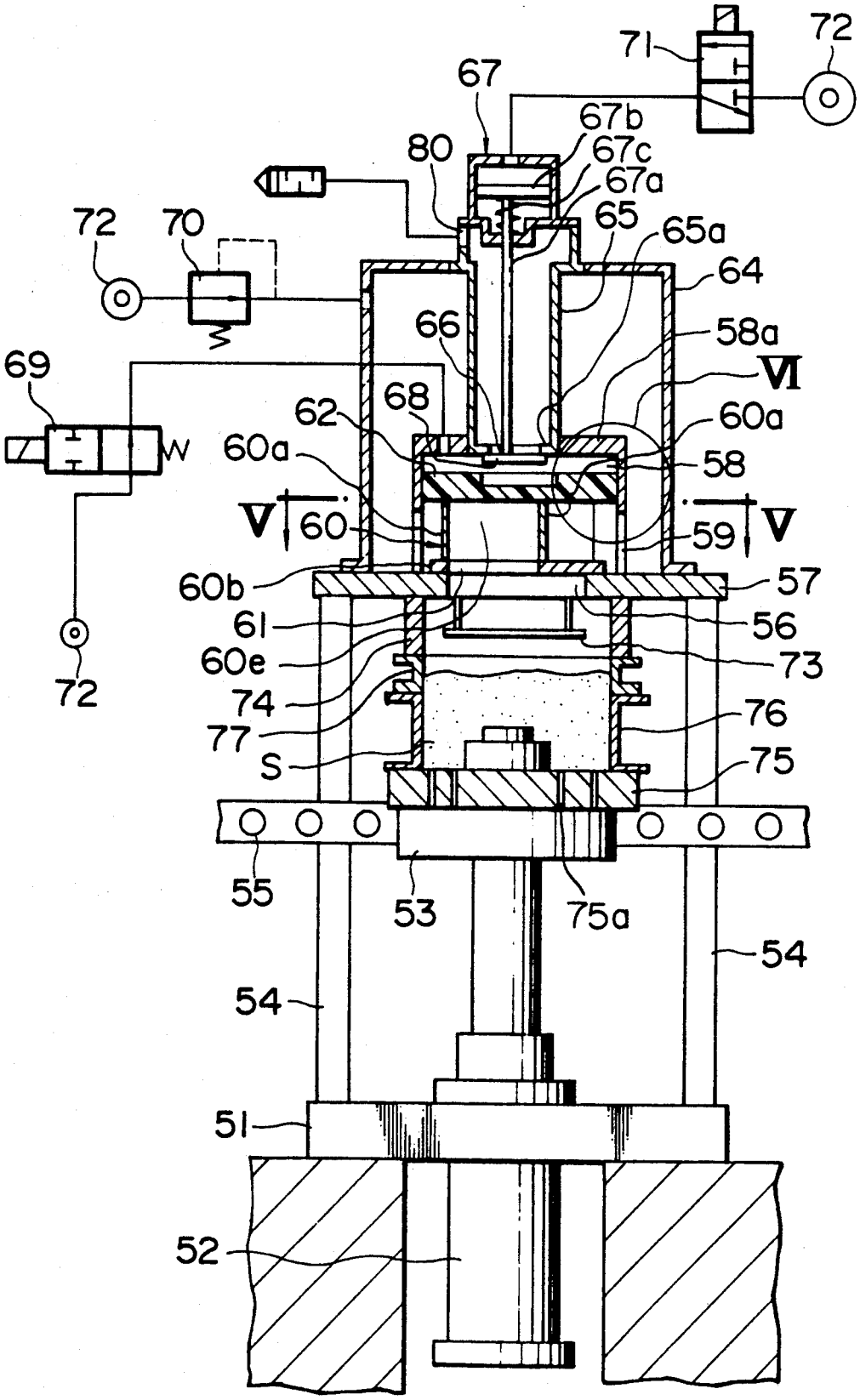
FIG. 4 is a partly-sectioned front elevational view of a second embodiment of the present invention.
Figure 5:
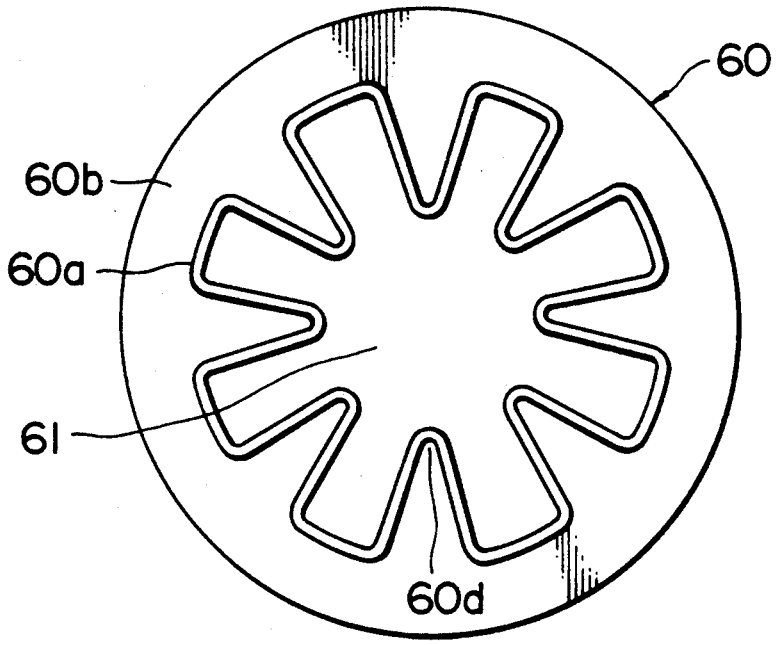
FIG. 5 is an enlarged view taken along line V—V of FIG. 4.

Then, a second embodiment of the present invention will now be described with reference to the drawings. As shown in FIG. 4, a table 53 is, via a cylinder 52 facing upwards, disposed at the central portion of a frame 51 in such a manner that the table 53 is able to move upwards/downwards. Furthermore, supporting columns 54 are erected at the four corners of the frame 51 in such a manner that a roller conveyer 55 extending horizontally is disposed at an intermediate portion of the supporting columns 54 and a surface-plate frame 57 having, at the central portion thereof, a compressed air outlet port 56 is disposed at the top end portions of the supporting columns 54. On the upper surface of the frame surface-plate 57, a cylinder 58 extending vertically and having the top end portion closed by a cover 58*a* is secured, surrounding the top end portion of the outlet port 56, the cylinder 58 having air supply holes 59 in the lower body thereof. At a position on the top surface of the surface-plate frame 57 and inside the cylinder 58, there is disposed a sectioning device 60 capable of efficiently supplying compressed air in a cover 64 which will be detailed hereinbelow, to the outlet port 56. As shown in FIG. 5, the sectioning device 60 comprises a cylindrical member 60*a* extending vertically and having a multiplicity of troughs 60*d* which extend vertically, the horizontal cross sectional shape of the cylindrical member 60*a* thereby being formed in a spur-like shape. The sectioning device 60 further comprises a cover member 60*b* hermetically secured to the lower end portion of the cylindrical member 60*a* and having a spur-like air feed hole 61 which is communicated with the inside portion of the cylindrical member 60*a*. The air feed hole 61 faces the outlet port 56.

Figure 6:
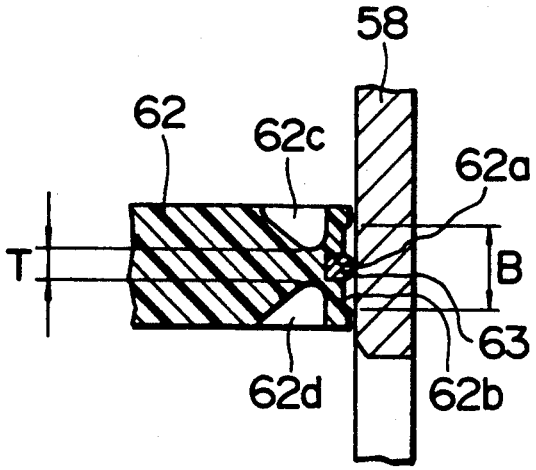
FIG. 6 is a detailed view which illustrates a portion VI shown in FIG. 4.

Similarly to the first embodiment, a piston 62 is disposed above the sectioning device 60 in the cylinder 58 so as to be slidable in the vertical direction, the piston 62 being made of a synthetic resin and thereby being lightweight. Furthermore, the piston 62 is arranged in such a manner that it can be brought into contact with the top end portion of the cylindrical member 60*a* of the sectioning device 60 in a hermetical manner when it is moved downward. In addition, a seal 63 is, as shown in FIG. 6, fitted in a groove 62*a* formed in the outer peripheral surface of the piston 62. The piston 62 has an annular recess 62*b* formed in the outer peripheral surface thereof and annular recesses 62*c* and 62*d* on the top and the lower surfaces thereof in such a manner that a thickness T defined between the bottom surfaces of the top and the lower recesses 62*c* and 62*d* is made to be smaller than width B of the recess 62*b*. As a result, when the piston 62 having a thermal expansion coefficient which is larger than that of the cylinder 58 is expanded at an increased temperature, the top and lower surfaces of the piston 62 can warp inwards, thereby preventing occurrence of an unfavorable problem.

Furthermore, a cover 64 is, as shown in FIG. 4, hermetically fastened to the top surface of the surface-plate frame 57, surrounding the cylinder 58, the cover 64 defining therein a compressed air reservoir tank in cooperation with the surface-plate frame 57. In addition, a cylindrical exhaust pipe 65 is hermetically fastened to the central portion of the ceiling of the cover 64, the exhaust pipe 65 vertically penetrating the ceiling and extending downwards. The exhaust pipe 65 hermetically penetrates the cover 58*a* of the cylinder 58, the exhaust pipe 65 having a second exhaust hole 80 in the upper portion thereof and a bottom plate 65*a* at the lower end portion thereof. The bottom plate 65*a* has a large-diameter first exhaust hole 66. In addition, a cylinder 67 facing downwards is fastened to the top end surface of the exhaust pipe 65, while a valve 68 capable of closing the above-described first exhaust hole 66 underneath thereof is fastened to the lower end portion of the piston rod 67*a* of the piston 67*b* in the cylinder 67, the piston 67*b* is urged upwards by a coil spring 67*c*.

The upper chamber above the piston 62 of the cylinder 58, and the chamber above the piston 67*b* in the cylinder 67 are respectively communicated with a compressed air source 72 via an opening/closing valve 69, and a 3-port 2-position switch valve 71. Further, the inside of the cover 64 is also communicated with the compressed air source 72 by way of a reducing valve 70.

Referring to FIG. 4, reference numeral 73 represents an air diffusion plate secured to the lower surface of the surface-plate frame 57, 74 represents a frame fastened to the surface-plate frame 57 in such a manner that it surrounds the air diffusion plate 73, 75 represents a pattern plate having a vent hole 75*a*, 76 presents a flask and 77 represents a cheek flask.

Then, the operation of the apparatus thus-constituted will now be described. The switch valve 71 is switched to the position disconnected from the compressed air source 72. The opening/closing valve 69 is opened to the position connected to the compressed air source 72 and the reducing valve 70 is adjusted to control compressed air to a predetermined pressure level. In this state, molding sand S is supplied into the flask 76 and the cheek flask 77 on the pattern plate 75, and then, the molding sand S is conveyed to a position above the table 53 by the roller conveyer 55. Then, the cylinder 52 is extended to move the table 53 upward so that the cheek flask 77 is brought into contact with the flask 76. Then, the opening/closing valve 69 is closed to stop the supply of compressed air into the chamber above the piston 62 of the cylinder 58. Then, the switch valve 71 is switched over to cause the piston 67*b* extend downwards. As a result, the valve 68 is moved downwards so that the first exhaust hole 66 is opened.

When the first exhaust hole 66 is opened, compressed air in the chamber above the piston 62 in the cylinder 58 is discharged outside after it has passed through the first exhaust hole 66, the exhaust pipe 65 and the second exhaust hole 80. Therefore, the pressure in the chamber above the piston 62 in the cylinder 58 is lowered. Furthermore, since compressed air in the cover 64 has been introduced into the troughs 60*d* formed in the cylindrical member 60*a* of the sectioning device 60, the lower surface of the piston 62 receives the pressure of compressed air most efficently. As a result, the piston 62 is pushed upwards at a high speed so that the opening 60*e* of the cylindrical member 60*a* is opened. Therefore, compressed air is, through a multiplicity of the troughs 60*d* formed in the cylindrical member 60*a*, introduced into the cylindrical member 60*a* along the, top end portion of the surrounding wall. Therefore, a large quantity of compressed air is quickly blown through the air feed hole 61 after it has passed through the cylindrical member 60*a*.

Compressed air blown from the air feed holes 61 is diffused by the air diffusion plate 73 to compress the molding sand S and as well as the compressed air penetrates the molding sand before it is discharged through the vent hole 75*a* formed in the pattern plate 75. As a result, the molding sand S is compressed. After the molding sand S has been compressed, the cylinder 67 is retracted by switching the switch valve 71 to close the first exhaust hole 66 by means of the valve 68. Then, the table 53 and the like are moved downwards by the retracting operation of the cylinder 52. Then, compressed air is supplied to the chamber above the cylinder 58 by opening 60*e* the opening/closing valve 69 so as to move the piston 62 downward. As a result, the piston 62 is brought into contact with the upper surface of the cylindrical member 60*a* and thereby the opening 60*e* is closed. The molding sand S, which has been previously compressed, is conveyed to the next station where it is further properly compressed. Thus, one cycle of the operation of the apparatus according to the present invention is completed.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A compressed air blowing apparatus including:

a frame having an air outlet port for supplying compressed air into a flask;

a cylindrical sectioning device disposed on said frame, having, in an end portion thereof, an air feed hole communicated with said air outlet port and having, in another end portion thereof, an opening communicated with said air feed hole;

a cylinder disposed on said frame to surround said sectioning device;

a piston capable of sliding in said cylinder;

a first compressed air supply device having a compressed air reservoir tank for supplying compressed air to a first chamber which is formed on one side of said piston in said cylinder and in which said sectioning device is disposed;

a second compressed air supply device for urging said piston to hermetically close said opening by supplying compressed air to a second chamber formed on the other side of said piston in said cylinder;

an exhaust hole for communicating said second chamber with the outside; and a valve for opening/closing said exhaust hole whereby, when said valve opens said exhaust hole, said piston pushed by compressed air supplied from said first compressed air supply device slides to open said opening and thereby compressed air supplied from said first compressed air supply device is introduced into said sectioning device through said opening before it is blown into said flask through said outlet port, characterized by:

a large and a small cylindrical members concentrically disposed and included in said sectioning device, wherein said opening is defined as an annular opening by end portions of said cylindrical members, and including a plurality of connecting ducts which establish a communication between the outside of said large cylindrical member and the inside of said small cylindrical member and which extend in the radial direction, whereby compressed air supplied from said first compressed air supply device is introduced into said opening from both outside of said large cylindrical member and inside of said small cylindrical member when said piston slides away from said opening.

2. A compressed air blowing apparatus including:

a frame having an air outlet port formed for supplying compressed air into a flask;

a cylindrical sectioning device disposed on said frame and, having, in an end portion thereof, an air feed hole communicated with said air outlet port and having, in another end portion thereof, an opening communicated with said air feed hole;

a cylinder disposed on said frame to surround said sectioning device;

a piston capable of sliding in said cylinder to hermetically close said opening formed in said sectioning device;

a first compressed air supply device having a compressed air reservoir tank for supplying compressed air to a first chamber which is formed on one side of said piston in said cylinder and in which said sectioning device is disposed;

a second compressed air supply device for urging said piston to hermetically close said opening by supplying compressed air to a second chamber formed on the other side of said piston in said cylinder;

an exhaust hole for communicating said second chamber with the outside;

a valve for opening/closing said exhaust hole whereby, when said valve opens said exhaust hole, said piston pushed by compressed air supplied from said first compressed air supply device slides to open said opening and thereby compressed air supplied from said first compressed air supply device is introduced into said sectioning device through said opening before it is blown into said flask through said outlet port, characterized by a cylindrical member an end portion of which defined said opening and which is provided in said sectioning device, wherein said cylindrical member has a plurality of troughs extending in an axial direction thereof and arranged in its circumferential direction, said troughs projecting inward.

3. A compressed air blowing apparatus for use in a green sand mold molding facility and acting to supply compressed air to molding sand supplied in a flask, said compressed air blowing apparatus comprising:

a surface-plate frame capable of closing an opening formed in a top end portion of said flask and having a compressed air outlet port formed into a through hole which faces said top end opening;

a cylinder fastened to the upper surface of said frame in such a manner that said outlet port is positioned inside thereof, extending vertically and formed in a cylindrical shape having a top end portion closed by a cover and having a first exhaust hole formed in said cover and an air supply hole formed in a lower portion of the cylinder;

a sectioning device placed in said cylinder on said frame and acting so as to supply compressed air to said outlet port;

a piston placed in said cylinder above said sectioning device for sliding vertically and contacting with a top end portion of said sectioning device in a hermetical manner;

a cover hermetically fastened to the upper surface of said frame to surround said cylinder and constituting a compressed air reservoir tank in cooperation with said frame, the compressed air reservoir tank being communicated with a compressed air source via pressure regulating valve;

an exhaust pipe having a lower end portion hermetically fastened to said cover of said cylinder to surround the first exhaust hole formed in said cover, and a top end portion communicated with the outside;

a valve disposed in such a manner that it is able to move vertically so as to open/close said first exhaust hole; and an opening/closing valve disposed at a position between a chamber formed above said piston in said cylinder and said compressed air source, wherein said sectioning device is constituted by large and small cylindrical members formed vertically and disposed substantially concentrically by a cover member hermetically secured to a lower end portions of said large and small cylindrical members and having a plurality of air feed holes formed between said large cylindrical member and said small cylindrical member and by connecting ducts for communicating and connecting said large cylindrical member and said small cylindrical member.

4. A compressed air blowing apparatus for use in a green sand mold molding facility according to claim 3, wherein said piston is made of a synthetic resin, a first annular recess is formed at the outer peripheral surface of said piston, upper and lower annular recesses are formed in the peripheral portions of top and lower surfaces of said piston and the thickness defined between bottom surfaces of said upper and lower annular recesses is smaller than the width of said first annular recess.

5. A compressed air blowing apparatus for use in a green sand mold molding facility and acting to supply compressed air to molding sand supplied in a flask, said compressed air blowing apparatus comprising:

a surface-plate frame capable of closing an opening formed in a top end portion of said flask and having a compressed air outlet port formed into a through hole which faces said top end opening;

a cylinder fastened to the upper surface of said frame in such a manner that said outlet port is positioned inside thereof, formed vertically and having a top end portion closed by a cover and having a first exhaust hole formed in said cover and an air supply hole formed in a lower portion of the cylinder;

a sectioning device placed in said cylinder on said frame and acting so as to supply compressed air to said outlet port;

a piston placed in said cylinder above said sectioning device for sliding vertically and contacting with a top end portion of said sectioning device in a hermetical manner;

a cover hermetically fastened to the upper surface of said frame to surround said cylinder and constituting a compressed air reservoir tank in cooperation with said frame, the compressed air reservoir tank being communicated with a compressed air source via a pressure regulating valve;

an exhaust pipe having a lower end portion hermetically fastened to said cover of said cylinder to surround the first exhaust hole formed in said cover and a top end portion communicated with the outside;

a valve disposed in such a manner that it is able to move vertically so as to open/close said first exhaust hole; and an opening/closing valve disposed at a position between a chamber formed above said piston in said cylinder and said compressed air source, wherein said sectioning device is constituted by a cylindrical member extending vertically and having the horizontal cross sectional shape which is formed into a spur-like shape and a cover member hermetically secured to a lower end portion of said cylindrical member and having an air feed hole which is communicated with an inside space of said cylindrical member.

6. A compressed air blowing apparatus for use in a green sand mold molding facility according to claim 5, wherein said piston is made of a synthetic resin, a first annular recess is formed at the outer peripheral surface of said piston, an upper annular and a lower annular recesses are formed in the peripheral portions of top and lower surfaces of said piston and the thickness defined between bottom surfaces of said upper and lower recesses is smaller than the width of said first annular recess.

* * * * *